US010128072B2

(12) United States Patent
Matsuyama et al.

(10) Patent No.: US 10,128,072 B2
(45) Date of Patent: Nov. 13, 2018

(54) PRESSURE SWITCH AND METHOD OF FORMING A DIAPHRAGM THEREIN

(71) Applicant: Kabushiki Kaisha Saginomiya Seisakusho, Tokyo (JP)

(72) Inventors: Kenichi Matsuyama, Tokorozawa (JP); Satoshi Miyakawa, Tokorozawa (JP); Ysohihiro Hamabe, Sayama (JP)

(73) Assignee: Kabushiki Kaisha Saginomiya Seisakusho, Tokyo (JP)

( * ) Notice: Subject to any disclaimer, the term of this patent is extended or adjusted under 35 U.S.C. 154(b) by 0 days.

(21) Appl. No.: 14/932,792

(22) Filed: Nov. 4, 2015

(65) Prior Publication Data

US 2016/0133409 A1 May 12, 2016

(30) Foreign Application Priority Data

Nov. 7, 2014 (JP) ..... 2014-227035

(51) Int. Cl.

| | |
|---|---|
| ***H01H 35/34*** | (2006.01) |
| ***H01H 1/06*** | (2006.01) |
| ***H01H 11/04*** | (2006.01) |
| *H01H 1/14* | (2006.01) |

(52) U.S. Cl.

CPC ..... *H01H 35/346* (2013.01); *H01H 1/06* (2013.01); *H01H 11/043* (2013.01); *H01H 2001/145* (2013.01)

(58) Field of Classification Search

CPC .... H01H 35/34; H01H 35/343; H01H 35/346; H01H 35/24; H01H 35/245; H01H 1/06

USPC ..... 200/83 N, 83 R, 83 B; 340/438

See application file for complete search history.

(56) References Cited

U.S. PATENT DOCUMENTS

| | | | | |
|---|---|---|---|---|
| 2,752,558 A * | 6/1956 | Kane | G01L 1/20 338/114 |
| 4,412,113 A * | 10/1983 | Mitsugi | H01H 13/48 200/242 |
| 5,004,876 A | 4/1991 | Sogge et al. | |
| 5,216,231 A | 6/1993 | Sato | |

(Continued)

FOREIGN PATENT DOCUMENTS

| | | |
|---|---|---|
| CN | 1755858 | 4/2006 |
| JP | S53-113379 | 2/1952 |

(Continued)

OTHER PUBLICATIONS

Partial English translation of Japanese patent document No. JPS53-113379 (U), published Feb. 14, 1952 (p. 3, lines 11-17 and p. 6, line 18 to p. 7, line 5).

(Continued)

*Primary Examiner* — Vanessa Girardi
(74) *Attorney, Agent, or Firm* — Workman Nydegger

(57) ABSTRACT

In a method of manufacturing a diaphragm with a contact, contact stocks each forming a movable contact on a stock formed out of a strip-shaped thin metal sheet material, or a rolled material are bonded at predetermined intervals to the stock by resistance welding, for example to form a diaphragm stock with a contact. Next, the stock of a diaphragm with a contact is subjected to continuous blanking with a predetermined diameter from each movable contact as center to produce a diaphragm with a contact.

16 Claims, 14 Drawing Sheets

(56) References Cited

U.S. PATENT DOCUMENTS

| | | | | |
|---|---|---|---|---|
| 5,828,016 | A * | 10/1998 | Grannan | H01H 13/48 200/16 R |
| 7,230,197 | B2 * | 6/2007 | Sano | H01H 13/48 200/406 |
| 7,525,060 | B2 * | 4/2009 | Sano | H01H 13/48 200/406 |
| 8,431,853 | B2 * | 4/2013 | Kwak | H01H 13/79 200/406 |
| 8,507,822 | B2 * | 8/2013 | Li | H01H 33/6646 218/118 |
| 8,525,055 | B2 * | 9/2013 | Brazier | H01M 2/1229 200/83 R |
| 2004/0000466 | A1 | 1/2004 | Kubat | |
| 2016/0133408 | A1 * | 5/2016 | Matsuyama | H01H 35/34 200/83 R |

FOREIGN PATENT DOCUMENTS

| | | | | |
|---|---|---|---|---|
| JP | S57-034908 | 8/1955 | | |
| JP | S59-018319 | 2/1984 | | |
| JP | H02-220320 | 9/1990 | | |
| JP | H05-282960 | 10/1993 | | |
| JP | H10-134681 | 5/1998 | | |
| JP | 2000-322963 | 11/2000 | | |
| JP | 2002-279875 | * 9/2002 | | H01H 35/34 |
| JP | 2003-234035 | 8/2003 | | |
| JP | 2004-311129 | 11/2004 | | |
| JP | 2007-311278 | 11/2007 | | |
| JP | 2012-221631 | 11/2012 | | |

OTHER PUBLICATIONS

Partial English translation of Japanese patent document No. JPS57-034908 (U), published Aug. 6, 1955 (p. 2, line 11 to p. 4, line 4).
Partial English translation of Japanese patent document No. JPS59-018319 (U), published Feb. 3, 1984 (p. 10, line 5 to p. 13, line 9).
Notification of Reasons for Refusal of JP2014-227035, drafted Feb. 27, 2017.
201510707184.X, Apr. 20, 2017, Chinese Office Action.

* cited by examiner

PRESSURE SWITCH AND METHOD OF FORMING A DIAPHRAGM THEREIN

CROSS-REFERENCES TO RELATED APPLICATIONS

This application claims the benefit of Japanese Patent Application No. 2014-227035, filed Nov. 7, 2014, which is hereby incorporated by reference wherein in its entirety.

BACKGROUND OF THE INVENTION

1. Field of the Invention

The present invention relates to a method of manufacturing a diaphragm with a contact, and a pressure switch including a diaphragm with a contact manufactured in accordance with the method.

2. Description of the Related Art

An air-conditioning system or the like generally includes a pressure switch which is provided to piping and configured to detect a pressure of a coolant, carbon dioxide gas, and the like in the piping and to send a detection output. As disclosed in Japanese Patent Laid-Open No. 2002-279875, such a pressure switch includes: a casing assembly connected to a coolant passage via one end of a joint pipe; a diaphragm laminate which partitions off a pressure sensing chamber as a pressure-receiving chamber in the casing assembly; and a rod capable of bringing a movable contact and a fixed contact that are located in the casing assembly close to or away from each other in response to a displacement of the diaphragm laminate. In the above-described configuration, grid-like multipoint contacts are formed on an upper face of the fixed contact which is opposed to the movable contact. Accordingly, if a foreign substance such as a fiber or a contaminant is caught between the fixed contact and the movable contact, continuity between the fixed contact and the movable contact is secured whereby occurrence of a continuity defect is avoided because the foreign substance is pushed into a recess between the multipoint contacts.

In addition, as disclosed in Japanese Patent Laid-Open No. H10-134681 (1998), for example, there is also proposed a pressure switch which is deprived of an actuating force transmission member such as the aforementioned actuating pin and is provided with a curved diaphragm in place of the above-described movable contact and a central part of the curved diaphragm is configured to invert so that the diaphragm can come into contact with or move away from a fixed contact. This diaphragm is held by a pressing portion of an insulator member to be fitted into a recess of a body, such that the curved portion of the diaphragm is opposed to the fixed contact. A surface of this diaphragm may be subjected to plating.

SUMMARY OF THE INVENTION

In the case of the pressure switch as disclosed in Japanese Patent Laid-Open No. H10-134681 (1998) mentioned above, when a peak (a contact) of the curved portion of the diaphragm subjected to plating is repeatedly brought into contact with the aforementioned fixed contact, a plated membrane at the peak of the curved portion of the diaphragm is peeled, with the result that the peak (the contact) of the curved portion of the diaphragm is worn. As a consequence, there is a risk of instability of electric connection between the peak (the contact) of the curved portion of the diaphragm and the fixed contact.

In view of the above-described problem, the present invention aims to provide a method of manufacturing a diaphragm with a contact and a pressure switch including a diaphragm with a contact manufactured in accordance with the manufacturing method. The method and the pressure switch can improve durability of a contact of a diaphragm and eventually improving continuity reliability as a switch.

To achieve the above described the object, a method of manufacturing a diaphragm with a contact according to the present invention comprises: bonding a contact stock to a stock made of a thin metal sheet material, the contact stock forming a movable contact having an excellent ability of durability and electrical continuity; and blanking the stock of a diaphragm with a contact which is bonded to the contact stock to form a diaphragm with a contact.

In addition, method of manufacturing a diaphragm with a contact according to the present invention comprises: blanking a stock made of a thin metal sheet material into a shape corresponding to a diaphragm; and bonding a contact stock to the stock blanked into the shape corresponding to the diaphragm, the contact stock forming a movable contact having an excellent ability of durability and electrical continuity to form a diaphragm with a contact.

In addition, a pressure switch including a diaphragm with a contact according to the present invention comprises: a housing to accommodate a connection terminal having a fixed contact therein; a pressure-receiving chamber communicating with a duct to which an actuating pressure is supplied; and a diaphragm formed in accordance with any of the above-described methods of manufacturing a diaphragm with a contact, configured to be displaced in response to a pressure inside the pressure-receiving chamber, and provided with a movable contact to come into contact with the fixed contact when the pressure inside the pressure-receiving chamber is equal to or above a predetermined value.

A contact face of the movable contact of the diaphragm may be formed into an annular shape, and a contact face of the fixed contact may be formed substantially into a cross shape. Alternatively, the contact face of the movable contact of the diaphragm may be formed into an annular shape, and the contact face of the fixed contact may be formed substantially into a Y-shape.

In addition, the contact face of the movable contact of the diaphragm may be formed substantially into a cross shape, and the contact face of the fixed contact may be formed into an annular shape. Alternatively, the contact face of the movable contact of the diaphragm may be formed substantially into a Y-shape, and the contact face of the fixed contact may be formed into an annular shape. Moreover, the contact stock may be made of an alloy containing any one of tin, indium, zinc, and nickel.

According to the method of manufacturing a diaphragm with a contact of the present invention, and the pressure switch including the diaphragm with a contact manufactured in accordance with the method, the method comprises bonding a contact stock to a stock made of a thin metal sheet material, the contact stock forming a movable contact having an excellent ability of durability and electrical continuity; and blanking the stock of a diaphragm with a contact which is bonded to the contact stock to form a diaphragm with a contact, whereby it is possible to improve durability of the contact of the diaphragm, and eventually to improve continuity reliability as a switch.

Further features of the present invention will become apparent from the following description of exemplary embodiments (with reference to the attached drawings).

DESCRIPTION OF THE EMBODIMENTS

Figure 2:
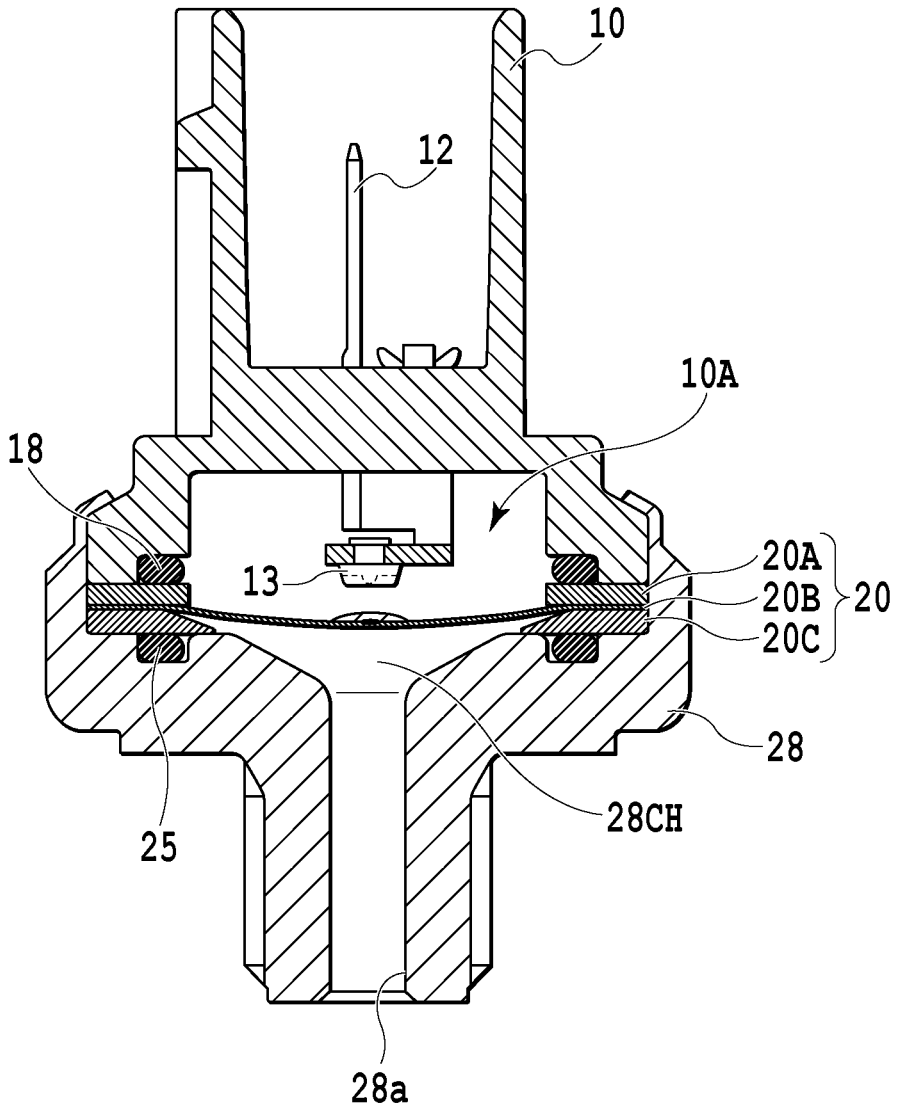
FIG. 2 is a cross-sectional view showing the configuration of the example of the pressure switch including the diaphragm with a contact according to the present invention.

FIG. 2 shows substantial part of an example of a pressure switch including a diaphragm with a contact, which is manufactured by a method of manufacturing a diaphragm with a contact according to the present invention.

The pressure switch is attached, for example, to a not-illustrated hydraulic device or piping to supply air, a coolant, water, or the like via a connection joint 28.

As shown in FIG. 2, the pressure switch is a normally-open switch. The pressure switch comprises, as its main constituents: a diaphragm assembly 20 joined to an end of the connection joint 28; a casing 10 connected to the connection joint 28 and incorporating a connection terminal 12 to be described later; and a fixed contact 13 of the connection terminal 12 provided inside the casing 10 and made capable of coming into contact with and being separated from a movable contact 20*br* of a diaphragm 20B to be described later in response to a displacement of the diaphragm 20B.

Figure 5:
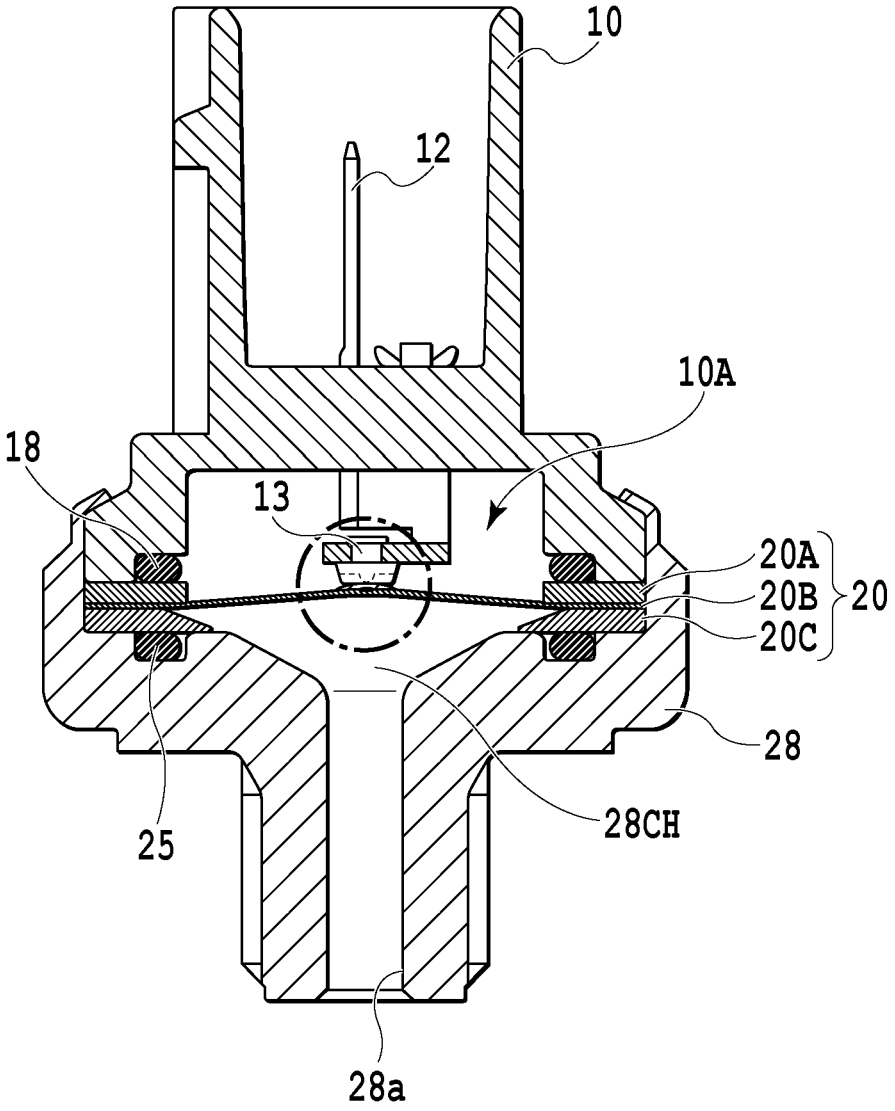
FIG. 5 is a cross-sectional view made available for explaining an operation in the example shown in FIG. 2.

The casing 10 as a housing is formed by using a resin material, for example, and is provided with a recess 10A located on inside of the casing 10 and designed to accommodate the fixed contact 13 of the connection terminal 12. An external connection part of the connection terminal 12 passes through a hole in the casing 10 and projects into a cavity which is formed on the outside. The external connection part of the connection terminal 12 is connected to a not-illustrated pressure detection circuit. Accordingly, when the movable contact 20*br* of the diaphragm 20B comes into contact with the fixed contact 13 as shown in FIG. 5 in response to inversion of the diaphragm 20B, a predetermined current is fed to the connection joint 28 via the diaphragm 20B, with the result that, the pressure detection circuit detects that a pressure inside a pressure-receiving chamber to be described later reaches a predetermined pressure.

The diaphragm assembly 20 is disposed in such a way as to serve as a partition between a pressure-receiving chamber 28CH communicating with a flow passage 28*a* of the connection joint 28 and an open end portion of the casing 10. The diaphragm assembly 20 comprises, as its main constituents: an upper plate 20A in contact with a peripheral edge of the open end portion of the casing 10 and with an O-ring 18; a lower plate 20C in contact with a peripheral edge of the pressure-receiving chamber 28CH of the connection joint 28 and with an O-ring 25; and the diaphragm 20B sandwiched between the upper plate 20A and the lower plate 20C opposed to each other.

The upper plate 20A is formed into an annular shape with a metal material, for example, and by press forming, cutting, die casting, forging, or the like.

The lower plate 20C is formed into an annular shape with a metal material, for example, and by press forming, cutting, die casting, forging, or the like. An annular groove into which the O-ring 25 is inserted is formed in the connection joint 28 at a peripheral edge of a hole of the lower plate 20C concentrically with the peripheral edge of the pressure-receiving chamber 28CH of the connection joint 28. The pressure-receiving chamber 28CH communicating with the flow passage 28*a* of the connection joint 28 is formed from a surface of the diaphragm 20B, an inner peripheral portion of the lower plate 20C, and an inner peripheral portion of the connection joint 28. On this occasion, an outer peripheral edge of the diaphragm 20B is sandwiched between the upper plate 20A and the lower plate 20C.

The diaphragm assembly 20 is produced by integrating the upper plate 20A and the lower plate 20C together while sandwiching the diaphragm 20B in between, by welding and thus bonding outer peripheral edges thereof. As a consequence, welded portions are formed on outer peripheral portions of the upper plate 20A and the lower plate 20C.

The diaphragm 20B is formed from a thin metal sheet material such as a stainless steel plate, which has corrosion resistance to the fluid supplied through the flow passage 28*a* in the connection joint 28, for example.

Figure 6:
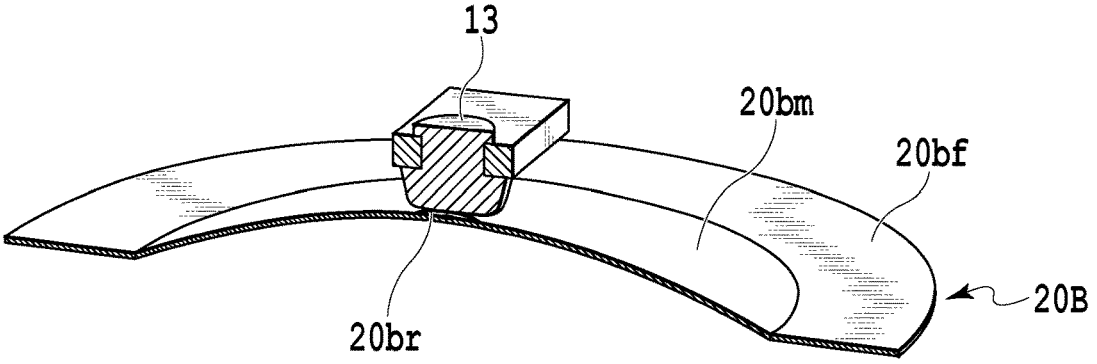
FIG. 6 is a perspective view including a cutaway view of a fixed contact and a diaphragm illustrated in FIG. 1.

As shown enlarged in FIG. 6, the diaphragm 20B comprises: a flange portion 20*bf* to be sandwiched between the upper plate 20A and the lower plate 20C; and a movable portion 20*bm* which is invertible, i.e., elastically deformable. The movable contact 20*br* having an annular contact face is bonded by resistance welding to be described later to a peak on a surface of the movable portion 20*bm* having a predetermined curvature radius and being opposed to the fixed contact 13. The movable contact 20*br* bulges upward by a predetermined height from the surface of the movable portion 20*bm* so as to come into contact with a cross-shaped contact face 13*bt* of the fixed contact 13 as shown partially enlarged in FIG. 1 and FIG. 7 when the diaphragm 20B is inverted.

In the above-described example, the diaphragm assembly 20 includes the upper plate 20A, the lower plate 20C, and the diaphragm 20B. However, the present invention is not limited to this example. For instance, the diaphragm assembly may be formed from the upper plate 20A and the diaphragm 20B, or formed from the lower plate 20C and the diaphragm 20B. Alternatively, instead of providing the diaphragm assembly 20, only the diaphragm 20B may be sandwiched between the casing 10 and the connection joint 28 directly through the O-rings.

Figure 3A:
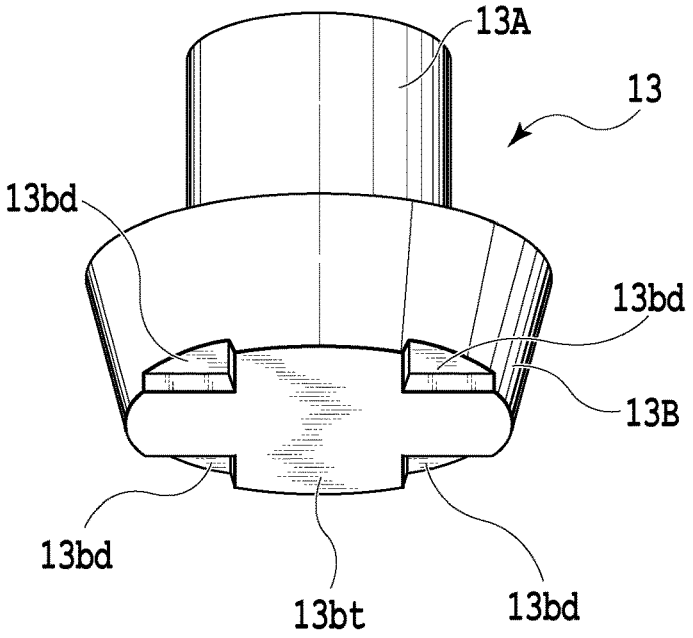
FIG. 3A is a perspective view showing a structure of the fixed contact shown in FIG. 1.
Figure 4:
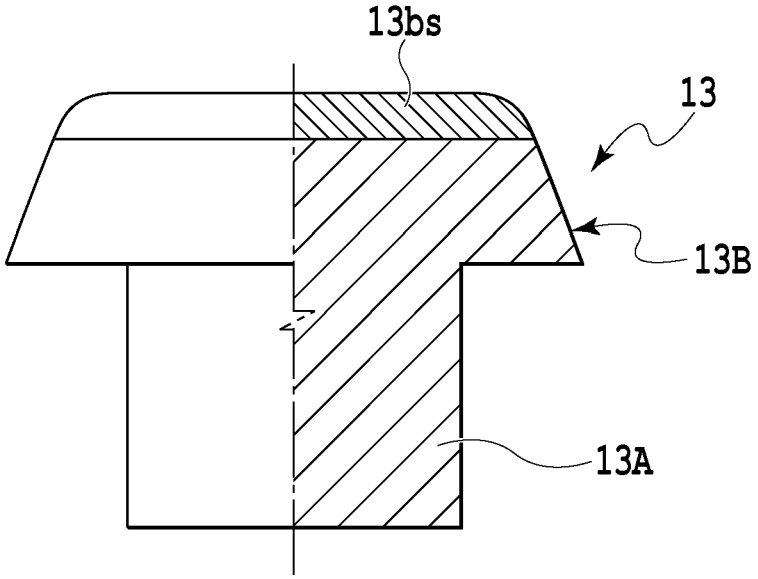
FIG. 4 is a cross-sectional view showing a structure of the fixed contact shown in FIG. 1.

As shown enlarged in FIG. 3A, the fixed contact 13 is made of copper-based metal or iron-based metal, for example, and includes a columnar portion 13A to be joined to a lower end of the connection terminal 12, and a contact portion 13B of a truncated cone shape integrally formed at a lower end of the columnar portion 13A. As shown in FIG. 4, a coating layer 13*bs* of a noble metal such as gold and silver having a predetermined film thickness is formed on a surface of the contact portion 13B.

As shown enlarged in FIG. 3A, an end surface of the contact portion 13B includes the substantially cross-shaped contact face 13*bt* formed from portions radially diverging at intervals of 90°. Cavities 13*bd* are formed at four positions around the contact face 13*bt* which is a flat end surface of the contact portion 13B.

Figure 1:
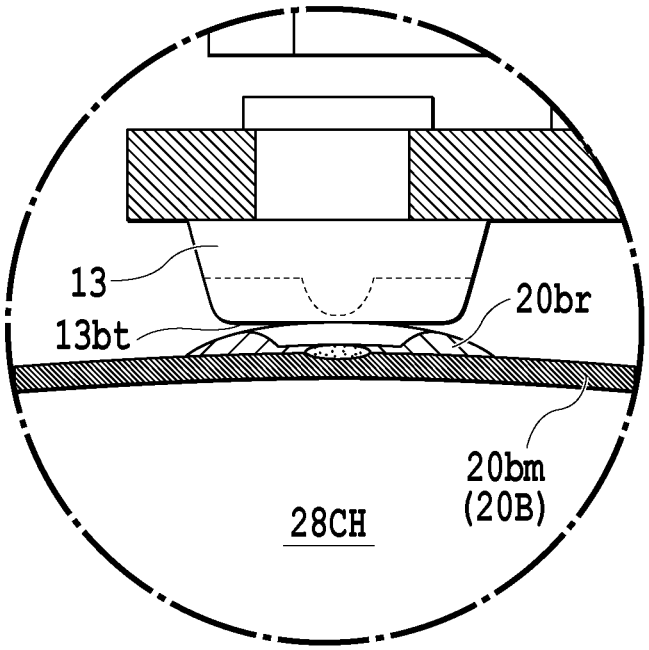
FIG. 1 is a partial cross-sectional view which shows enlarged part of a configuration of an example of a pressure switch including a diaphragm with a contact according to the present invention.
Figure 7:
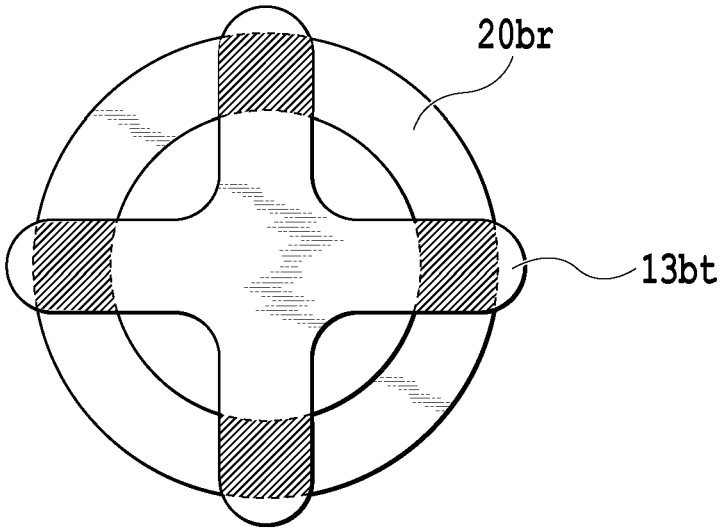
FIG. 7 is a diagram showing a relative position of the fixed contact to a movable contact of the diaphragm.

Thus, when the diaphragm 20B is inverted, the cross-shaped contact face 13*bt* of the fixed contact 13 comes into contact with the annular movable contact 20*br* at four positions as shown enlarged in FIG. 1. Accordingly, since the contact face 13*bt* comes into contact with the annular movable contact 20*br* at the four positions, it is possible to achieve reliable electrical connection between the diaphragm 20B and the fixed contact 13 in case a foreign substance is caught between the peak of the inverted diaphragm and part of the fixed contact 13. In addition, the cross-shaped contact face 13*bt* comes into contact with the annular movable contact 20*br* at the four positions with equal pressures as shown in FIG. 7. As a consequence, an impact at the time of the inversion of the diaphragm 20B is dispersed, and durability of the annular movable contact 20*br* of the diaphragm 20B is improved.

Note that the contact face 13*bt* at the end surface of the contact portion 13B described above is not limited to this example. For instance, as shown in FIG. 3B, a contact face 14*bt* formed from a convex arc-shaped surface having a predetermined curvature radius may be provided instead.

Figure 3B:
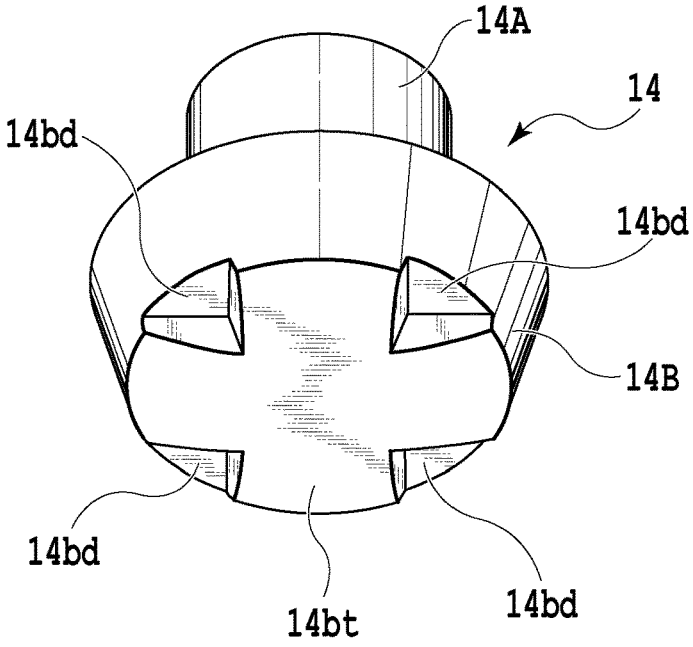
FIG. 3B is a perspective view showing variations of the fixed contact shown in FIG. 3A.

In FIG. 3B, a fixed contact 14 having the contact face 14*bt* is made of copper-based metal or iron-based metal, for example, and includes a columnar portion 14A to be joined to the lower end of the connection terminal 12, and a contact portion 14B of a truncated cone shape integrally formed at a lower end of the columnar portion 14A. A coating layer of a noble metal such as gold and silver having a predetermined film thickness is formed on a surface of the contact portion 14B. As shown enlarged in FIG. 3B, an end surface of the contact portion 14B includes a substantially cross-shaped contact face 14*bt* formed from portions radially diverging at intervals of 90°. Cavities 14*bd* are formed at four positions around the contact face 14*bt*, which is the convex arc-shaped surface of the contact portion 14B.

In the above-described configuration, when a pressure inside the pressure-receiving chamber 28CH is below a predetermined value, as shown in FIG. 2, the movable contact 20*br* of the diaphragm 20B is located away from the cross-shaped contact face 13*bt* of the fixed contact 13. Accordingly, the above-mentioned pressure detection circuit detects that the pressure inside the pressure-receiving chamber 28CH is below the predetermined value since a given current is not fed to the connection joint 28 via the diaphragm 20B. On the other hand, when the pressure inside the pressure-receiving chamber 28CH is equal to or above the predetermined value, the movable contact 20*br* of the diaphragm 20B comes into contact with the cross-shaped contact face 13*bt* of the fixed contact 13. Accordingly, the above-mentioned pressure detection circuit detects that the pressure inside the pressure-receiving chamber 28CH is equal to or above the predetermined value since the given current is fed to the connection joint 28 via the diaphragm 20B.

Figure 8A:
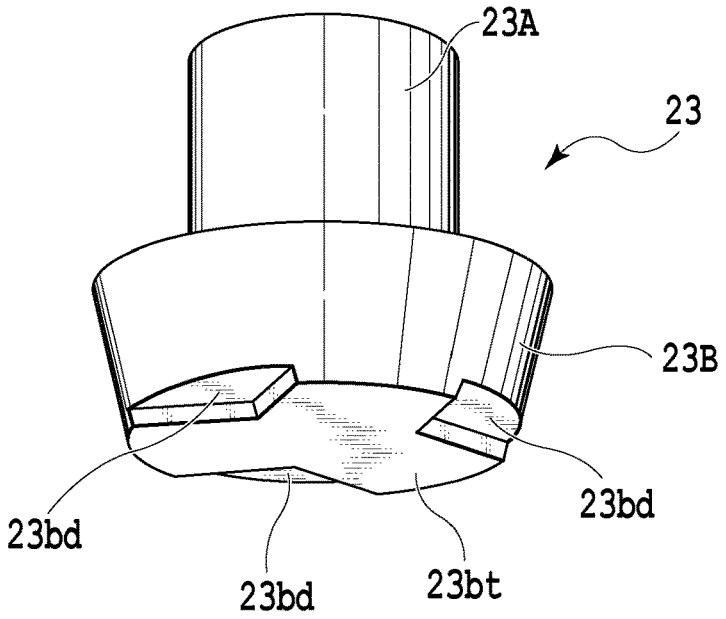
FIG. 8A is a perspective view showing external appearance of another example of the fixed contact used in the example shown in FIG. 1.

In the above-described example, the end surface of the contact portion 13B of the fixed contact 13 has the cross-shaped contact face 13*bt*. However, the fixed contact is not limited to this example. For instance, as shown enlarged in FIG. 8A, an end surface 23B of a fixed contact 23 may have a substantially Y-shaped contact face 23*bt*.

The fixed contact 23 having the contact face 23*bt* is made of copper-based metal or iron-based metal, for example, and includes a columnar portion 23A to be joined to the lower end of the connection terminal 12, and a contact portion 23B of a truncated cone shape integrally formed at a lower end of the columnar portion 23A.

The substantially Y-shaped contact face 23*bt* is formed from portions radially diverging at intervals of 120°, for example. Cavities 23*bd* are formed at three positions around the contact face 23*bt* which is a flat end surface of the contact portion 23B.

In this case, when the diaphragm 20B is inverted, the Y-shaped contact face 23*bt* of the fixed contact 23 comes into contact with the annular contact 20*br* at three positions.

Figure 8B:
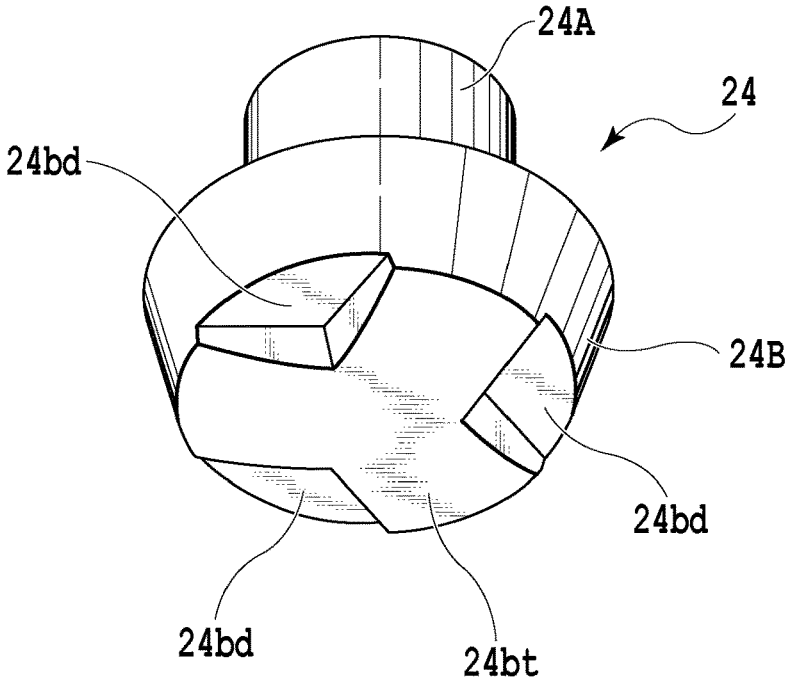
FIG. 8B is a perspective view showing variations of the fixed contact shown in FIG. 8A.

Note that the contact face 23*bt* at the end surface of the contact portion 23B is not limited to this example. For instance, as shown enlarged in FIG. 8B, a contact face 24*bt* formed from a convex arc-shaped surface having a predetermined curvature radius may be provided instead.

A fixed contact 24 having the contact face 24*bt* is made of copper-based metal or iron-based metal, for example, and includes a columnar portion 24A to be joined to the lower end of the connection terminal 12, and a contact portion 24B of a truncated cone shape integrally formed at a lower end of the columnar portion 24A.

The substantially Y-shaped contact face 24*bt* is formed from portions radially diverging at intervals of 120°, for example. Cavities 24*bd* are formed at three positions around the contact face 24*bt* which is the convex arc-shaped surface of the contact portion 24B.

In this case, when the diaphragm 20B is inverted, the Y-shaped contact face 24*bt* of the fixed contact 24 comes into contact with the annular movable contact 20*br* at three positions.

Figure 9:
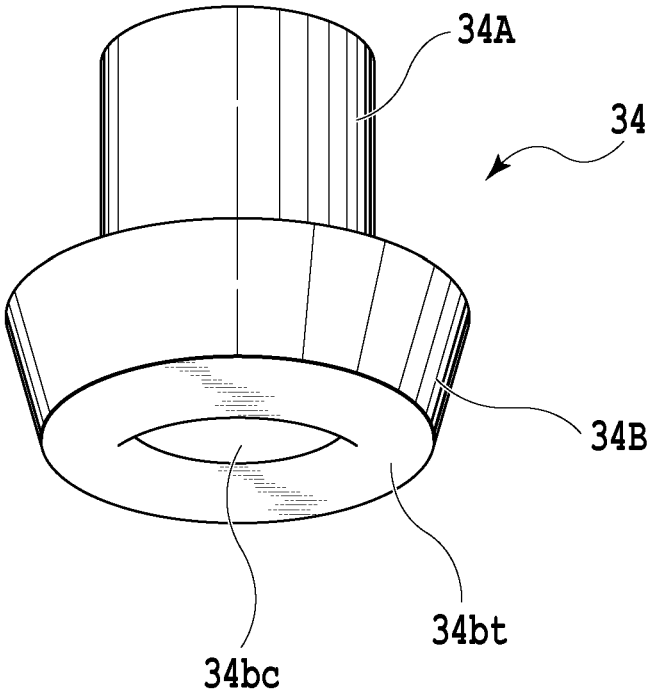
FIG. 9 is a perspective view showing external appearance of still another example of the fixed contact used in the example shown in FIG. 1.

Furthermore, the fixed contact is not limited to the examples shown in FIG. 3A, 3B and FIG. 8A, 8B. For instance, as shown enlarged in FIG. 9, a fixed contact 34 may be made of copper-based metal or iron-based metal, for example, and may include a columnar portion 34A to be joined to the lower end of the connection terminal 12, and a contact portion 34B of a truncated cone shape integrally formed at a lower end of the columnar portion 34A. A cavity 34*bc* is formed at a central part of an annular (donut-like) contact face 34*bt* at a flat end surface of the contact portion 34B. On this occasion, the contact face 34*bt* at the end surface of the contact portion 34B is not limited to this example. For instance, the contact face 34*bt* may be formed from a convex arc-shaped surface having a predetermined curvature radius.

Figure 10:
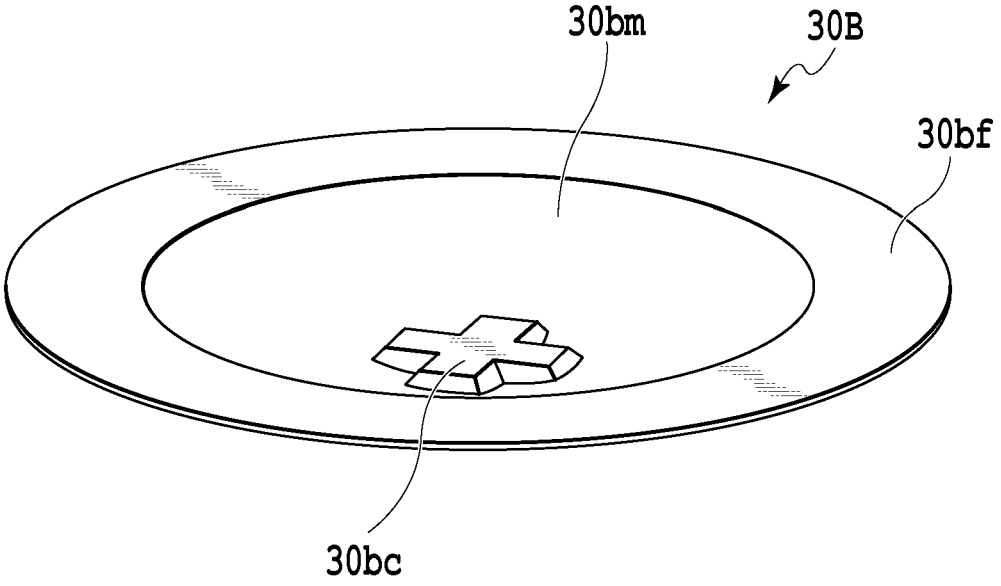
FIG. 10 is a perspective view showing another example of the diaphragm used in the example shown in FIG. 1.

In this case, as shown enlarged in FIG. 10, a diaphragm 30B to be combined with the fixed contact 34 is formed from a flange portion 30*bf* to be sandwiched between the upper plate 20A and the lower plate 20C, and a movable portion 30*bm* which is invertible, i.e., elastically deformable. A cross-shaped movable contact 30*bc* is bonded by resistance welding at a peak on a surface of the movable portion 30*bm*, which is formed to project toward the lower plate 20C, has a predetermined curvature radius, and is opposed to the fixed contact 34. The movable contact 30*bc* bulges by a predetermined height from the surface of the movable portion 30*bm* so as to come into contact with the annular contact face 34*bt* of the fixed contact 34 when the diaphragm 30B is inverted. Note that the contact face of the movable contact 30*bc* is not limited to this example. For instance, the contact face may be formed as a concave arc-shaped surface having a predetermined curvature radius.

Figure 11:
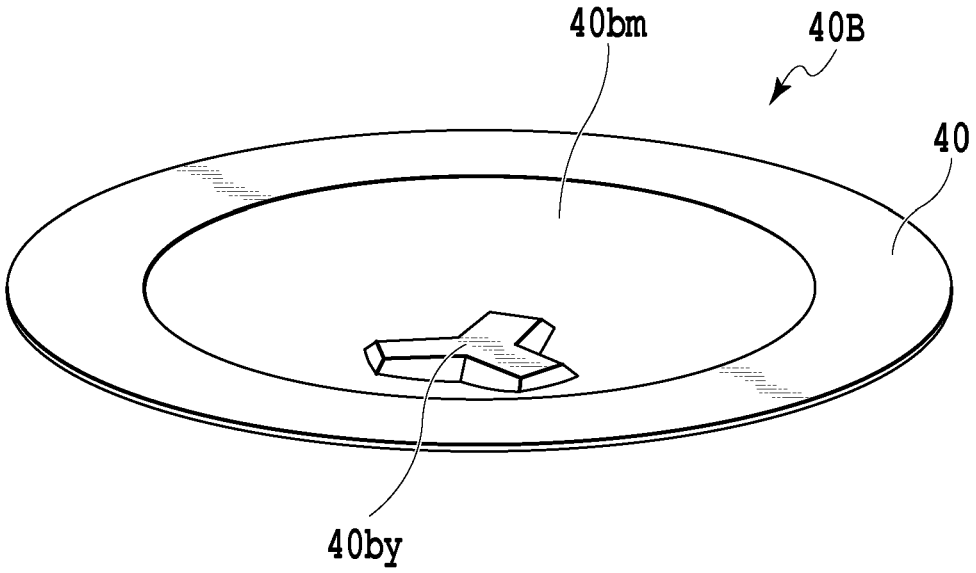
FIG. 11 is a perspective view showing another example of the diaphragm used in the example shown in FIG. 1.

In addition, a diaphragm 40B to be combined with the fixed contact 34 is not limited to the above-described example. For instance, as shown in FIG. 11, the diaphragm 40B is formed from a flange portion 40*bf* to be sandwiched between the upper plate 20A and the lower plate 20C, and a movable portion 40*bm* which is invertible, i.e., elastically deformable. A Y-shaped movable contact 40*by* is bonded by resistance welding at a peak on a surface of the movable portion 40*bm*, which is formed to project toward the lower plate 20C, has a predetermined curvature radius, and is opposed to the fixed contact 34. The movable contact 40*by* bulges by a predetermined height from the surface of the movable portion 40*bm* so as to come into contact with the annular contact face 34*bt* of the fixed contact 34 when the diaphragm 40B is inverted. Note that the contact face of the movable contact 40*by* is not limited to this example. For instance, the contact face may be formed as a concave arc-shaped surface having a predetermined curvature radius.

The diaphragms 20B, 30B, and 40B described above are each manufactured in accordance with an example of a method of manufacturing a diaphragm with a contact of the present invention to be described below.

Figure 12A:
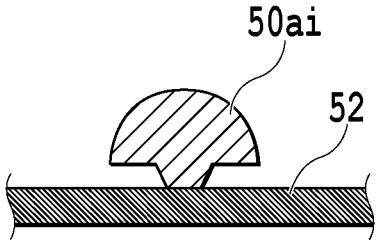
FIG. 12A and FIG. 12B are partial cross-sectional views made available for explaining an example of a method of manufacturing a diaphragm with a contact according to the present invention.
Figure 12B:
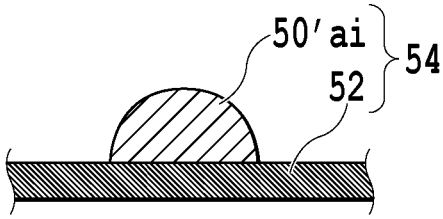

In the case of manufacturing a diaphragm 56 with a contact (see FIG. 14B), contact stocks 50*ai* (i=1 to n, n is a positive integer) each forming a movable contact on a stock 52 formed out of a strip-shaped thin metal sheet material (a rolled material) shown in FIG. 12A are bonded at predetermined intervals as shown in FIG. 12B to the stock 52 by resistance welding, for example. Each contact stock 50*ai* has a shape corresponding to any one of the movable contact 20*br* shown in FIG. 6, the movable contact 30*bc* shown in FIG. 10, and the movable contact 40*by* shown in FIG. 11, for example. Each contact stock 50*ai* has a diameter in a range from 2.6 mm to 3.0 mm inclusive, for instance. The contact stocks 50*ai* may be formed from a noble metal such as gold or silver, which is excellent in abrasion resistance and electrical continuity. Or, the contact stocks 50*ai* may be formed from a clad material containing a noble metal such as gold or silver. The contact stock may be formed from an alloy containing any one of tin (Sn), tin oxide, indium (In), indium oxide, zinc (Zn), zinc oxide, and nickel, for example, in order to improve abrasion resistance. Or, the contact stock may be formed from any one of silver alloys including, for example: an alloy of silver and zinc; an alloy of silver, tin, and indium; and an alloy of silver and nickel. Thus, the movable contacts having an excellent ability of abrasion resistance and electrical continuity than those of the movable contacts subjected to plating are obtained as a consequence.

Figure 13A:
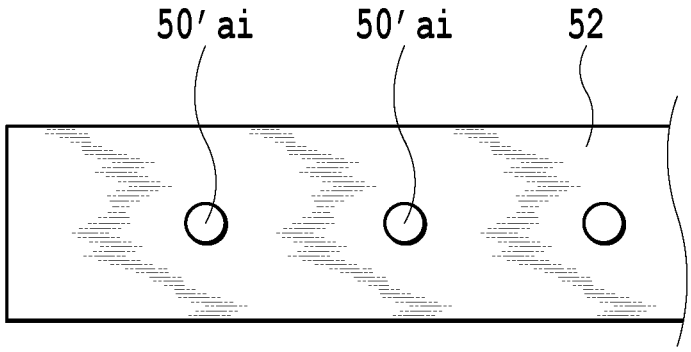
FIG. 13A is a plan view made available for explaining the example of the method of manufacturing a diaphragm with a contact according to the present invention.
Figure 13B:
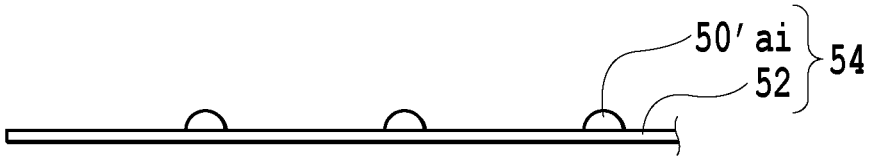
FIG. 13B is a front view corresponding to FIG. 13A.

Accordingly, as shown in FIGS. 13A and 13B, a plurality of movable contacts 50'*ai* (I=1 to n, n is the positive integer) are formed in a line at predetermined intervals on the stock 52. The stock 52 has a width slightly larger than the diameter of each diaphragm 56, and a predetermined length sufficient to produce a plurality of diaphragms 56 therefrom. The stock 52 may be either a single plate material having the predetermined length or a continuous plate material such as a rerolled material, which is rolled and has the predetermined length. As a consequence, a stock 54 of a diaphragm with a contact is formed from the plurality of movable contacts 50'*ai* and the stock 52 as shown in FIGS. 13A and 13B.

Figure 14A:
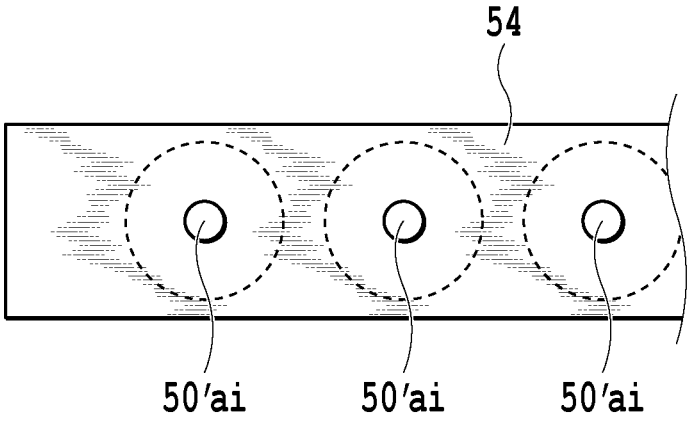
FIG. 14A and FIG. 14B are views made available for explaining the example of the method of manufacturing a diaphragm with a contact according to the present invention.
Figure 14B:
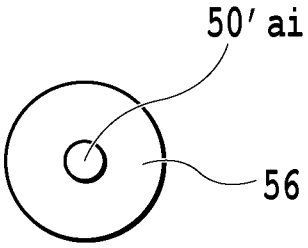

Next, as shown in FIG. 14A, the stock 54 of a diaphragm with a contact is placed on a given press machine (not illustrated), and is then subjected to continuous blanking with a predetermined diameter from each of the movable contacts 50'*ai* as center as indicated with dashed lines in FIG. 14A. Thus, the diaphragm 56 with a contact is produced as shown in FIG. 14B.

Accordingly, characteristics of the movable contact 50'*ai* of the diaphragm 56 with a contact including its abrasion resistance and continuity reliability are improved as compared to those of the diaphragm with a contact which is subjected to plating.

In the above-described example, the diaphragm 56 with a contact is produced by forming the stock 54 of a diaphragm with a contact and then blanking the stock 54 of a diaphragm with a contact by using the press machine. However, the diaphragm 56 with a contact does not always have to be manufactured as described above. For example, the stock 52 may be first formed into a circular piece by blanking and then the contact stock 50*ai* may be bonded by resistance welding to the circular stock produced by blanking. On this occasion, the contact stock 50*ai* may be bonded to the stock 52 not by resistance welding but by other bonding methods including brazing, diffusion bonding, and the like.

The example of the pressure switch according to the present invention is applied to the normally-open switch. However, the present invention is not limited to this example and may naturally be applied to a normally-closed switch, for instance. Moreover, the diaphragm with the contact manufactured by an example of a method of manufacturing a diaphragm with a contact according to the present invention is applied to the pressure switch to be connected to the piping via the connection joint 28. However, the present invention is not limited to this example. For instance, the present invention may also be applied to a pressure switch disclosed in Japanese Patent Laid-Open No. H 02-220320 (1990) or Japanese Patent No. 3,031,679.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A pressure switch, the pressure switch comprising:

a housing to accommodate a connection terminal having a fixed contact therein, wherein the fixed contact includes a protruding portion, the fixed contact disposed in a recess on a first side of the housing and the connection terminal disposed in a cavity on a second side of the housing;

a pressure-receiving chamber communicating with a duct to which an actuating pressure is supplied; and a diaphragm with a contact formed from a contact stock bonded to a diaphragm stock that is blanked to form the diaphragm with the contact, wherein the diaphragm is disposed as a partition between the pressure-receiving chamber and the recess in which the fixed contact is accommodated, wherein the diaphragm with the contact is configured to be displaced in response to a pressure inside the pressure-receiving chamber, wherein the contact stock forms a movable contact to be bonded to the diaphragm, the movable contact that comes into contact with the fixed contact when the pressure inside the pressure-receiving chamber is equal to or above a predetermined value, and the movable contact has electrical continuity with the diaphragm, wherein the movable contact protrudes from a surface of the diaphragm, wherein the movable contact includes an elevated portion and a recessed portion, wherein the elevated portion of the moveable contact is shaped and positioned to contact the protruding portion of the fixed contact at multiple non-contiguous positions and a contact face of the elevated portion of the movable contact is formed as a concave arc-shaped surface or a convex arc-shaped surface.

2. The pressure switch including a diaphragm with a contact according to claim 1, wherein a contact face of the movable contact of the diaphragm is formed into an annular shape, and a contact face of the fixed contact is formed substantially into a cross shape.

3. The pressure switch including a diaphragm with a contact according to claim 1, wherein a contact face of the movable contact of the diaphragm is formed into an annular shape, and a contact face of the fixed contact is formed substantially into a Y-shape.

4. The pressure switch including a diaphragm with a contact according to claim 1, wherein a contact face of the movable contact of the diaphragm is formed substantially into a cross shape, and a contact face of the fixed contact is formed into an annular shape.

5. The pressure switch including a diaphragm with a contact according to claim 1, wherein a contact face of the movable contact of the diaphragm is formed substantially into a Y-shape, and a contact face of the fixed contact is formed into an annular shape.

6. The pressure switch according to claim 1, wherein the contact stock is made of an alloy containing any one of tin, indium, zinc, and nickel.

7. A pressure switch including a diaphragm with a contact, the pressure switch comprising:

a housing to accommodate a connection terminal having a fixed contact therein, wherein the fixed contact includes a protruding portion, the fixed contact disposed in a recess on a first side of the housing and the connection terminal disposed in a cavity on a second side of the housing;

a pressure-receiving chamber communicating with a duct to which an actuating pressure is supplied; and a diaphragm with a contact formed from a diaphragm stock that is blanked, wherein the blanked diaphragm stock is bonded to a contact stock to form the diaphragm with the contact, wherein the diaphragm is disposed as a partition between the pressure-receiving chamber and the recess in which the fixed contact is accommodated, wherein the diaphragm with the contact is configured to be displaced in response to a pressure inside the pressure-receiving chamber, wherein the contact stock forms a movable contact to be bonded to the diaphragm, the movable contact that comes into contact with the fixed contact when the pressure inside the pressure-receiving chamber is equal to or above a predetermined value, and the movable contact has electrical continuity with the diaphragm, wherein the movable contact protrudes from a surface of the diaphragm, wherein the movable contact includes an elevated portion and a recessed portion, wherein the elevated portion of the moveable contact is shaped and positioned to contact the protruding portion of the fixed contact at multiple non-contiguous positions and a contact face of the elevated portion of the movable contact is formed as a concave arc-shaped surface or a convex arc-shaped surface.

8. The pressure switch including a diaphragm with a contact according to claim 7, wherein a contact face of the movable contact of the diaphragm is formed into an annular shape, and a contact face of the fixed contact is formed substantially into a cross shape.

9. The pressure switch including a diaphragm with a contact according to claim 7, wherein a contact face of the movable contact of the diaphragm is formed into an annular shape, and a contact face of the fixed contact is formed substantially into a Y-shape.

10. The pressure switch including a diaphragm with a contact according to claim 7, wherein a contact face of the movable contact of the diaphragm is formed substantially into a cross shape, and a contact face of the fixed contact is formed into an annular shape.

11. The pressure switch including a diaphragm with a contact according to claim 7, wherein a contact face of the movable contact of the diaphragm is formed substantially into a Y-shape, and a contact face of the fixed contact is formed into an annular shape.

12. The pressure switch according to claim 7, wherein the contact stock is made of an alloy containing any one of tin, indium, zinc, and nickel.

13. A method of manufacturing a diaphragm with a contact for being used in a pressure switch, the method comprising:

bonding a contact stock to a stock made of a thin metal sheet material to form a stock of the diaphragm with the contact for being used in a pressure switch that includes a fixed contact that includes a protruding portion, the contact stock forming a movable contact to be bonded to the diaphragm and having durability and providing electrical continuity with the diaphragm, wherein the movable contact protrudes from a surface of the thin metal sheet material;

blanking the stock of the diaphragm with the contact for being used in a pressure switch to form the diaphragm with the contact for being used in a pressure switch, wherein the movable contact includes an elevated portion and a recessed portion, and wherein the elevated portion of the movable contact is shaped to contact the protruding portion of the fixed contact at multiple non-contiguous positions by an action of a fluid pressure and a contact face of the elevated portion of the movable contact is formed as a concave arc-shaped surface or a convex arc-shaped surface.

14. The method of manufacturing a diaphragm with a contact according to claim 13, wherein the contact stock is made of an alloy containing any one of tin, indium, zinc, and nickel.

15. A method of manufacturing a diaphragm with a contact for being used in a pressure switch, the method comprising:

blanking a stock made of a thin metal sheet material into a diaphragm stock whose shape corresponds to the diaphragm;

bonding a contact stock to the diaphragm stock to form the diaphragm with the contact for being used in a pressure switch, wherein the pressure switch includes a fixed contact that includes a protruding portion, the contact stock forming a movable contact to be bonded to the diaphragm and having durability and providing electrical continuity with the diaphragm, wherein the movable contact protrudes from a surface of the diaphragm stock, wherein the movable contact includes an elevated portion and a recessed portion, and wherein the elevated portion of the movable contact is shaped to contact the protruding portion of the fixed contact at multiple non-contiguous positions by an action of a fluid pressure and a contact face of the elevated portion of the movable contact is formed as a concave arc-shaped surface or a convex arc-shaped surface.

16. The method of manufacturing a diaphragm with a contact according to claim 15, wherein the contact stock is made of an alloy containing any one of tin, indium, zinc, and nickel.

* * * * *